US005098490A

United States Patent [19]

Huu

[11] Patent Number: 5,098,490

[45] Date of Patent: Mar. 24, 1992

[54] SUPER POSITION ALUMINUM ALLOY CAN STOCK MANUFACTURING PROCESS

[76] Inventor: Shin Huu, 3rd Floor, No. 74, Fu Shin Shing Lane, Chiang Chian Zone, Kao-Hsuing, Taiwan

[21] Appl. No.: 593,805

[22] Filed: Oct. 5, 1990

[51] Int. Cl.[5] ..... C22F 1/04

[52] U.S. Cl. ..... 148/12.7 A; 148/11.5 A; 148/159; 148/415; 148/417; 148/440

[58] Field of Search ..... 148/12.7 A, 11.5 A, 148/159, 415, 417, 440

[56] References Cited

U.S. PATENT DOCUMENTS

| | | | |
|---|---|---|---|
| 2,137,624 | 11/1938 | Nook et al. | 148/12.7 R |
| 2,572,562 | 10/1951 | Harrington | 148/159 |
| 3,642,542 | 2/1972 | Sperry et al. | 148/12.7 R |
| 3,843,418 | 10/1974 | Oida et al. | 148/12.7 R |
| 3,935,007 | 1/1976 | Baba et al. | 420/535 |
| 4,065,326 | 12/1977 | Nicoud | 148/2 |
| 4,174,232 | 11/1979 | Lenz et al. | 148/2 |
| 4,282,044 | 8/1981 | Robertson et al. | 148/2 |
| 4,323,399 | 4/1982 | Dubost et al. | 148/12.7 A |
| 4,517,034 | 5/1985 | Merchant et al. | 148/11.5 A |
| 4,605,448 | 8/1986 | Baba et al. | 148/12.7 A |
| 4,637,842 | 1/1987 | Jeffrey et al. | 148/12.7 A |

*Primary Examiner*—R. Dean
*Assistant Examiner*—Robert R. Koehler
*Attorney, Agent, or Firm*—Burns, Doane, Swecker & Mathis

[57] ABSTRACT

A process for the manufacture of an aluminum alloy sheet from an aluminum alloy of the alumium-magnesium-manganese type which is believed to be substantially un-heat treatable. This process comprises the solution heat treatment of the alloy, quenching of the alloy, cold rolling of the alloy, an artificial aging of the alloy. Moreover, the period of time from the end of the quenching to the beginning of the artificial aging is not greater than about 10 minutes. The process can further comprise the homogenation, hot rolling, coiling, first cold rolling, annealing, and second cold rolling prior to the solution heat treatment of the alloy. The product can be effectively employed as a can stock.

35 Claims, No Drawings

SUPER POSITION ALUMINUM ALLOY CAN STOCK MANUFACTURING PROCESS

BACKGROUND OF THE INVENTION

The present invention relates to a process for producing an aluminum alloy sheet of predetermined final gauge. In particular, the process can be used to provide an aluminum alloy sheet which can be employed as a can stock.

A variety of aluminum alloys are known within the art. These alloys include 3000 series (aluminum-magnesium-manganese), and 5000 series (aluminum-magnesium).

In the past, a conventional sheet for can body stock has comprised an aluminum alloy from the 3000 series, in particular, alloy having the Aluminum Association designation AA3004. This stock is an aluminum-manganese alloy which has been produced from conventionally direct-chill-cast ingot up to 24 inches thick by scalping and homogenizing the ingot, and successively hot rolling and cold rolling to the desired final gauge. In addition, an anneal treatment step is often employed between the hot and cold rolling operations, with the annealing gauge so selected so that the amount of cold reduction to final gauge after annealing is about 85 percent, to thereby provide can body stock and H19 (extra hard) temper. This practice imparts the combination of properties currently required for commercial body stock.

However, because the 3004 alloy has relatively low strength and ductility, its use as a can top end, and other similar applications, is greatly limited. Furthermore, because these alloys belong to the aluminum-manganese series, they have largely been considered to be un-heat treatable when compared to, for example, the Al—Mg—Si, Al—Cu—Mg, and Al—Zn—Mg series.

Even in those instances when certain 3004 alloys have been "heat treated", see, for example, U.S. Pat. No. 3,787,248 to Setzer et al., the conditions have been carefully controlled. Moreover, an alloy such as that disclosed in Setzer cannot be effectively employed as can tops and similar applications.

Accordingly, the need still exists for a process for providing a can stock from an alloy such as AA3004 which can stock has improved strength and ductility.

It is an object of the present invention to provide a process for the heat treatment of aluminum alloys, particularly un-heat treatable aluminum alloys such as AA3004.

These and further objects will become apparent from this specification and claims which follow.

SUMMARY OF THE INVENTION

In accordance with the foregoing objectives, the present invention relates to a process for the manufacture of an aluminum alloy sheet from an aluminum alloy of the aluminum-magnesium-manganese type.

In particular, the process comprises homogenizing the alloy, heating the alloy under conditions effective to attain phase transformation and spheridize the second phase, hot rolling the alloy to a first thickness, coiling the alloy at a temperature effective to prevent the alloy from becoming work hardened, cold rolling the alloy to a second thickness, and annealing the alloy, cold rolling the alloy to a third thickness, solution heat treating the alloy under conditions effective to increase the strength of the alloy, quenching the alloy, cold rolling the alloy to a desired final thickness, an artificial aging the alloy under conditions which effectively maintain the strength of the alloy. Furthermore, the period of time between the quench and the beginning of artificial aging is sufficient so as to prevent the excessive hardening of the material.

In another aspect, the present invention relates to the product formed by this process particularly the ability to employ the product as a canned stock.

DETAILED DESCRIPTION OF THE PREFERRED EMBODIMENTS

The present invention relates to a process for producing an aluminum alloy sheet of predetermined final gauge.

The aluminum alloys which can be effectively employed within the present invention include those alloys of the aluminum-manganese-magnesium type, particularly those members of the 3000 series, previously believed to be substantially un-heat treatable. Such alloys include those alloys having about 1% Mg and greater than about 0:2% Si. Specific examples include AA3004, as well as those alloys disclosed in U.S. Pat. No. 4,269,032. Exemplary alloys are illustrated in Table A below:

TABLE A

Si 0.30% maximum
Fe 0.70% maximum
Cu 0.25 maximum
Mn 1.0 to 1.5%
Mg 0.8 to 1.3%
Zn 0.25% maximum
Ti 0.05% maximum The alloy can be used in any suitable form which is recognized in the art, for example, in the shape of an ingot.

The ingot can be cast by any suitable methods known in the art such as the direct chill process. The direct chill casting process is well known in the art and need not be described in detail.

As an example, the molten metal is poured at a predetermined temperature range, i.e., 700° to 750° C., into a mold. The mold has fixed side walls and a moveable bottom in the case of a vertical mold, or fixed side walls with a removable side plug in the case of a horizontal mold.

The metal which has been poured into the mold solidifies and the solid portion is slid from the mold, and through the fixed walls, as the moveable portion of the mold is withdrawn. The fixed walls are internally cooled and lubricated so as to facilitate passage there through of solidified metal. Metal leaving the mold is cooled with a direct spray of water onto the mold or ingot.

After casting, the materials in the ingot are homogenized. During this homogenation process, the ingot is heated by any suitable means, for example, an oven or a furnace at a predetermined temperature, e.g., about 530° to about 580° C. preferably about 545° to about 580° C., for a soaking time of, e.g., about 24° to about 30 hours. The ingot is then effectively cooled in order to provide for the complete homogenation of the materials. Preferably, this occurs, in the oven, at a rate of about 30° C. per hour down to a final temperature of about 200° C. at which point the ingot is removed from the oven and allowed to further cool to ambient temperatures.

This cooling can occur by any suitable means, e.g., either in or out of the homogenation oven or furnace. For example, the ingot can be cooled in the furnace by opening the furnace door or it can be removed from the furnace for cooling.

After homogenation, the ingot is milled down to an effective size to remove the casting segregations and/or casting defects from the broader sides of the ingot. A preferred size for use in the process of the present invention is about 10 mm on each side.

The thickness of the ingot is then decreased in a series of rolling steps. The thickness for each of the rolling step is dependent upon the rolling mill employed with the preferred values, for the thicknesses discussed below being based on the use of conventional rolling mills.

Prior to the first of these steps, the ingot is effectively heat soaked under conditions sufficient to attain phase transformation and spheridize the second phase. This provides an alloy having higher ductility and sufficient work hardening strength after cold rolling. Furthermore, it reduces the hot working resistance and/or improves the hot working properties of the alloy.

This heat soaking occurs at a predetermined temperature of, e.g., preferably about 540° C. to about 570° C. Furthermore, this heating can occur within any suitable means, for example, an oven. The soaking time employed is dependent upon the thickness of the ingot. For strips with a thickness not greater than about 75 mm, the preferred soak time is about 6 hours with the preferred soak time increasing about 1 hour for each additional 25 mm of thickness.

Subsequent to the heat soaking, the strip is rolled down to a first thickness. When conventional rolling mills are employed, this first thickness is preferably about 5 to about 8 mm, most preferably about 6 mm. This hot rolling can be provided by any suitable means within the art. However, hot rolling is preferably accomplished through a multiple pass system because the lower reduction ratio associated with each pass of a multiple pass system provides a product with the optimal properties.

The hot strip is then coiled prior to cold rolling. This occurs at a temperature which effectively prevents the strip from becoming too hard, e.g., work hardened and thus less suitable for the cold rolling process. Preferably, a temperature not less than about 345° C. is employed. If a temperature less than about 450° C. is employed, the strip needs to be annealed at an effective temperature, e.g., about 450° C., to remove the work hardening effect.

The coiled strip is then cold rolled down to a second thickness which is preferably about 3.0 to about 3.5, most preferably about 3.2 mm. This cold rolling can also occur by any suitable method known in the art. However, a multiple pass treatment, e.g., 3 passes, is preferred due to the increased formability associated therewith.

The strip is then annealed prior to further cold rolling. Annealing comprises the heat treatment at a temperature above the recrystallization temperature of the alloy and is designed to remove the preferred orientation of the grains of the alloy that result from hot working below the recrystallization temperature. In the process of the present invention, annealing can be carried out at any effective temperature but is preferably carried out at a temperature of about 400° to about 500° C., more preferably about 450° C.

The annealing step can be preformed by any suitable means, for example, in an oven or by flash annealing. However, due to the preferred thickness of the coil strips, oven annealing is preferred.

After annealing, the strip is cold rolled to a third thickness and heat treated to final gauge. More preferably, the strip is first cold rolled to the third thickness which is preferably 0.8 to 1.0 mm, more preferably about 0.9 mm and then subjected to the solution heat treatment.

During this solution heat treatment, the strip is preferably heated at a temperature of, e.g., about 530 to about 540° C. for a period of time of, e.g., about 4 hours.

The strip is then water quenched and cold rolled to the desired final thickness. Preferably, this thickness is about 0.4 to about 0.45 mm, more preferably 0.41 to about 0.43 mm.

After this cold rolling, the strip is then "artificially aged" or "stabilized" in order to maintain the strength of the alloy while improving elongation. In the present invention, the strip can be artificially aged in any suitable means, for example, an oven, at any effective temperature, e.g., preferably 170° to about 180° C., more preferably, e.g., 175° C. for an effective period of time, e.g., about 4 hours.

Moreover, in the process of the present invention, the time period between the water quench and the beginning of the stabilizing step is controlled so as to prevent excessive hardening of the material and the decreased strength which can be associated therewith. Preferably, in the process of the present invention, this time period does not exceed 10 minutes. The use of this time period is also capable of increasing the formability and elongation, e.g., about 2 to 3%.

As indicated herein above, it has been found that the process of the present invention is effective in the heat treatment of heretofore un-heat treatable alloys. Due to the lesser cold reduction ratio, particularly when compared to conventional processes, the process of the present invention is capable of accelerating the can making processes while decreasing the amount of scrap produced. Furthermore, the final product produced by the process of the present invention has a reduced cold rolling ratio compared with conventional treated alloys. The product also has a much higher tensile strength, i.e., the strength can be increased by as much as 3,000 psi, smaller earing ratios, (e.g. 0.4 or less) as well as increased ductility, formability, and elongation. In addition, the product allows the production of a can from a single can stock.

In order to further illustrate the present invention and the advantages which can be associated therewith, the following specific example is given, it being understood that the same is intended only as illustrative and in nowise limitive.

EXAMPLE

Aluminum Alloy 3004 is homogenized in an oven at 550° C. for 30 hours. The alloy is then cooled down to 200° C. at a rate of 30° C. every hour. An ingot is formed by milling down the alloy sheet to 10 mm on each broad side.

The ingot, which has a about a 13" thickness, is introduced into an oven at 520° C. and soaked for 16 hours. The ingot is then hot rolled down to a 6 mm thickness, coiled at a temperature of 345° C. and then cold rolled in a three pass system down to a thickness of 3.2 mm.

The strip is then annealed in an oven at 450° C. and subsequently cold rolled down to a thickness of about 0.8 to 1.0 mm.

The rolled sheet is solution heat treated at 540° C. for four hours, water quenched, cold rolled to a thickness of about 0.42 mm, and then artificially aged at 175° C. for four hours. The period of time between the water quenching and the beginning of artificial aging was 10 minutes.

While the invention has been described in terms of various preferred embodiments, the artisan will appreciate the various modifications, substitutions, omissions, and changes may be made without the departing from the spirit thereof. For these reasons, it is intended that the scope of the present invention be defined solely by the scope of the following claims including equivalents thereof.

What is claimed is:

1. A process for the manufacturing of an aluminum alloy sheet from an aluminum alloy of the aluminum-magnesium-manganese type comprising:

(a) homogenizing the alloy;
(b) heating the alloy under conditions effective to attain phase transformation and spheridize the second phase;
(c) hot rolling the alloy to a first thickness;
(d) coiling the alloy at a temperature effective to prevent the alloy from becoming work hardened;
(e) cold rolling the alloy to a second thickness;
(f) annealing the alloy;
(g) cold rolling the alloy to a third thickness;
(h) solution heat treating the alloy;
(i) quenching the alloy;
(j) cold rolling the alloy to a desired final thickness;
(k) artificial aging of the alloy under conditions which effectively maintain the strength of the alloy while improving elongation;

wherein the period of time between the (i) quench and the beginning of (k) artificial aging is chosen so as to prevent excessive hardening of the material.

2. The process of claim 1 wherein the alloy is in the shape of an ingot and the ingot is milled down between (a) and (b).

3. The process of claim 2 wherein the ingot is milled to a size of about 10 mm on each side.

4. The process of claim 1 wherein (a) comprises both the heating of the alloy to a temperature sufficient to homogenize the alloy and subsequent cooling of the alloy.

5. The process of claim 4 wherein the alloy is cooled to a temperature of about 200° C.

6. The process of claim 1 when the heating of (b) occurs at a temperature of about 540° to about 570° C.

7. The process of claim 1 wherein during (b) the alloy has thickness less than about 75 mm and is heated for a time period of about 6 hours.

8. The process of claim 1 wherein the first thickness is about 5 to about 8 mm.

9. The process of claim 8 wherein the first thickness is about 6 mm.

10. The process of claim 1 wherein the coiling of (d) occurs at a temperature of not less than about 345° C.

11. The process of claim 1 wherein the second thickness is about 3 to about 3.5 mm.

12. The process of claim 11 wherein the second thickness is about 3.2 mm.

13. The process of claim 1 wherein annealing of (f) comprises oven annealing at about 400° to about 500° C.

14. The process of claim 1 wherein third thickness is about 0.8 to about 1.0 mm.

15. The process of claim 14 wherein the third thickness is about 0.9 mm.

16. The process of claim 1 wherein the solution heat treatment in (h) occurs at a temperature of about 530° to about 540° C.

17. The process of claim 16 where in the solution heat treatment occurs for a period of time of about 4 hours.

18. The process of claim 1 wherein the quench of (i) is a water quench.

19. The process of claim 1 wherein the desired thickness is about 0.41 to about 0.43 mm.

20. The process of claim 1 wherein the artificial aging of (k) occurs at a temperature of about 170° to about 180° C.

21. The process of claim 1 wherein the period of time between the quench of (i) and the beginning of the artificial aging of (k) is not greater than about 10 minutes.

22. The process of claim 1 wherein the aluminum alloy comprises a Al—Mn—Mg series alloy having about 1% Mg and greater than about 0.2% Si.

23. The process of claim 1 wherein the aluminum alloy comprises AA3004.

24. The process of claim 1 wherein the alloy comprises AA3004, the heating in (b) occurs at about 520° C., the coiling of (d) occurs at a temperature of not less than about 345° C., the annealing (f) occurs at a temperature of about 450° C., the solution heat treatment of (h) occurs at a temperature of about 540° C. for about 4 hours, the artificial aging of (k) occurs at a temperature of about 175° C. and the time between quench (i) and the beginning of artificial aging is not greater than about 10 minutes.

25. The product made by the process according to claim 1.

26. The product made by the process according to claim 24.

27. The product of claim 25 wherein the aluminum alloy sheet is a can stock.

28. The product of claim 26 wherein the aluminum alloy sheet is a can stock.

29. A heat treating process for the manufacture of a homogenized aluminum alloy sheet from a substantially un-heat treatable alloy of the aluminum-magnesium-manganese type comprising:

(a) solution heat treatment of the aluminum alloy;
(b) quenching of the alloy;
(c) cold rolling of the alloy; and
(d) artificial aging of the alloy; further wherein the period of time from the end of (b) to the beginning of (d) is not greater than about 10 minutes.

30. The process according to claim 29 wherein the solution heat treatment occurs at a temperature of about 540° C. for about 4 hours.

31. The process according to claim 30 wherein the artificial aging occurs at a temperature of about 175° C.

32. The process of claim 31 wherein the alloy has a Mg content of 0.8 to 1.3%, a Mn content of 1.0 to 1.5%, a silicon content not greater than about 0.3%, and not greater than about 0.7% Fe.

33. The process of claim 31 wherein the alloy is AA3004 aluminum alloy.

34. The process of claim 32 further comprising hot rolling, coiling, a first cold rolling, annealing, and second cold rolling of the alloy prior to the solution heat treatment of the alloy.

35. The process of claim 33 further comprising hot rolling, coiling, a first cold rolling, annealing, and second cold rolling of the alloy prior to the solution heat treatment of the alloy.

* * * * *